US005161396A

United States Patent [19]

Loeff

[11] Patent Number: 5,161,396

[45] Date of Patent: Nov. 10, 1992

[54] TAMPER PROOF LOCKABLE FIREARM CASE

[76] Inventor: Thomas Loeff, 840 Michigan Ave., #15, Evanston, Ill. 60202

[21] Appl. No.: 724,193

[22] Filed: Jul. 1, 1991

[51] Int. Cl.[5] ..... E05B 65/52

[52] U.S. Cl. ..... 70/63; 206/317; 340/825.31; 109/59 T; 70/285; 70/279

[58] Field of Search ..... 70/63, 279, 281, 285; 206/317; 340/825.3, 825.31, 825.56; 109/59 R, 59 T, 45; 312/333, 319, 301

[56] References Cited

U.S. PATENT DOCUMENTS

| | | | |
|---|---|---|---|
| 2,485,051 | 10/1949 | Joslin | 70/456 R |
| 3,536,017 | 10/1970 | Lucas | 70/446 |
| 3,559,929 | 2/1971 | Lindsey, Jr. | 89/28.05 |
| 3,999,792 | 12/1976 | Smith | 292/DIG. 63 |
| 4,309,065 | 1/1982 | Pappas | 312/319 |
| 4,475,247 | 10/1984 | Lee | 206/317 |
| 4,646,080 | 2/1987 | Genest et al. | 340/825.31 |
| 4,651,544 | 3/1987 | Hungerford | 70/279 |
| 4,663,621 | 5/1987 | Field et al. | 340/825.31 |
| 4,688,023 | 8/1987 | McGill et al. | 206/1.5 |
| 4,768,021 | 8/1988 | Ferraro | 70/63 |
| 4,800,822 | 1/1989 | Adkins | 312/319 |
| 4,890,466 | 1/1990 | Cislo | 70/63 |
| 5,009,088 | 4/1991 | Cislo | 70/63 |
| 5,048,682 | 9/1991 | Taylor | 206/317 |
| 5,056,342 | 10/1991 | Prinz | 70/63 |
| 5,070,714 | 12/1991 | Bedford | 70/289 |
| 5,111,755 | 5/1992 | Rouse | 70/63 |

OTHER PUBLICATIONS

Xerox Disclosure Journal, vol. 1, No. 2, Feb. 1976.

*Primary Examiner*—Renee S. Luebke
*Assistant Examiner*—D. Boucher
*Attorney, Agent, or Firm*—H. Jay Spiegel

[57] ABSTRACT

Disclosed is a tamper proof lockable firearm case having an internal chamber sized and configured to store a firearm. The case has a door which may be opened responsive to unlocking a computer controlled lock. The lock actuator consists of depressions in the case corresponding to fingers of the user's hand, with each depression having an actuator button. Depressing a sequence of buttons including simultaneous and sequential depressions in a pre-programmed sequence results in unlocking of the case and opening of the door to allow access to the firearm. A key lock is also provided in the event of battery failure.

10 Claims, 7 Drawing Sheets

TAMPER PROOF LOCKABLE FIREARM CASE

BACKGROUND OF THE INVENTION

The present invention relates to a tamper proof lockable firearm case. In the prior art, containers designed to be used to store firearms are known. However, Applicant is unaware of any such device having all of the features of portability, safety, ease of use and resistance to tampering as are included in the present invention.

The following prior art is known to Applicant:

U.S. Pat. No. 3,307,755 to Lentz discloses a firearm safety box which includes a rotary-type combination lock controlling access to the internal chamber thereof. Additional features incorporated in the Lentz device include a rod insertable within the firearm barrel and an additional device inserted within the clip chamber to render the firearm incapable of discharge while secured within the box. The present invention differs from the teachings of this patent as including a much more sophisticated locking mechanism which is less likely to be tampered with while also protecting the firearm in a manner allowing immediate use upon removal from the case.

U.S. Pat. No. 3,329,278 to Pachmayr discloses a gun holding tray having an undulating clip designed to be used to hold the opposed barrels of adjacent pistols. The present invention differs from the teachings of Pachmayr for many reasons including the fact that the Pachmayr device does not lock the firearms within the tray thereof.

U.S. Pat. No. 3,369,721 to Lentz arose from a divisional application from the application which matured into the above-discussed U.S. Pat. No. 3,307,755. As such, the disclosures thereof are the same as are the distinctions therefrom.

U.S. Pat. No. 4,119,199 to Whitaker, Jr. discloses a child-resistant firearm receptacle which includes no locking device but, instead, incorporates a spring designed to hold halves of the device together unless a large enough force is applied thereto. Of course, the subject invention includes a sophisticated locking mechanism no where taught or suggested by Whitaker, Jr.

U.S. Pat. No. 4,721,205 to Burt et al. discloses a firearm container having a base designed to hold the firearm and a cover which is mounted thereover. Again, Burt et al. fail to disclose any locking means nor any of the other detailed aspects of the present invention.

SUMMARY OF THE INVENTION

The present invention relates to a tamper proof lockable firearm case. The present invention includes the following interrelated objects, aspects and features:

1) In a first aspect, the inventive tamper proof lockable firearm case includes an outer housing preferably having a trapezoidal cross-section having top and bottom surfaces angled with respect to one another and parallel front and rear surfaces.

2) In the preferred embodiment, the front surface of the housing has a door which, when opened, allows access to a firearm stored therein.

3) The latter-mentioned door is preferably pivotably mounted on the case with a hinge including a spring biasing means biasing the door to an open position. A latching mechanism allows the door to be latched in a closed position against the force of the spring bias.

4) In the preferred embodiment, on the top surface of the case, a plurality of recesses are provided, preferably four in number, and designed to correspond with the four fingers (besides the thumb) of a human hand. At the tip of each recess, an actuator button is provided which when depressed causes the closing of a switch in a battery powered electrical circuit forming a part of the present invention. If desired, each recess may contain one or more protrusions with each recess having a different pattern of protrusions to allow one to determine which recesses and thereby which buttons are being engaged even in the dark. By depressing the buttons in a sequence of depressing steps, with each step consisting of the depression simultaneously of one or a plurality of buttons, a combination pre-programmed within the electrical circuitry of the present invention may be entered which, if correctly entered, results in release of the latching mechanism and opening of the forward surface door. A key lock is also provided to allow opening of the door should the battery be dead.

5) The electrical circuitry of the present invention incorporates the buttons and switches described above as well as logic/decoder circuitry designed to receive impulses indicative of the particular buttons depressed, circuitry to analyze the sequence of buttons depressed and compare them with the preprogrammed reference sequence and, responsive to the correct sequence being entered, to cause actuation of a door latch releasing mechanism.

6) In the preferred embodiment of the present invention, a solenoid actuator is provided to allow release of the latch of the door. In the de-energized position of the solenoid, a spring holds the door latch closed. When the proper sequence of depressions of the buttons has been entered, the solenoid is activated for a prescribed period of time thereby pushing the latch against the force of the above-described spring to the open position. The above described key lock, when actuated, moves the latch against the force of the spring.

7) If desired, the circuitry may activate an alarm responsive to a predetermined number of attempts to enter sequences of depressions, which attempts fail. The circuitry may also include a time delay feature allowing entry of only a limited number of sequences of depressions of the buttons within a prescribed period of time.

As such, it is a first object of the present invention to provide a tamper proof lockable firearm case.

It is a further object of the present invention to provide such a device including a sophisticated computer operated combination locking mechanism.

It is a still further object of the present invention to provide such a device having an ergonometrically designed keypad intended to allow effective use even in the dark.

It is a still further object of the present invention to provide a solenoid actuator for a door allowing access to a firearm which actuator may be supplemented with a key lock.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
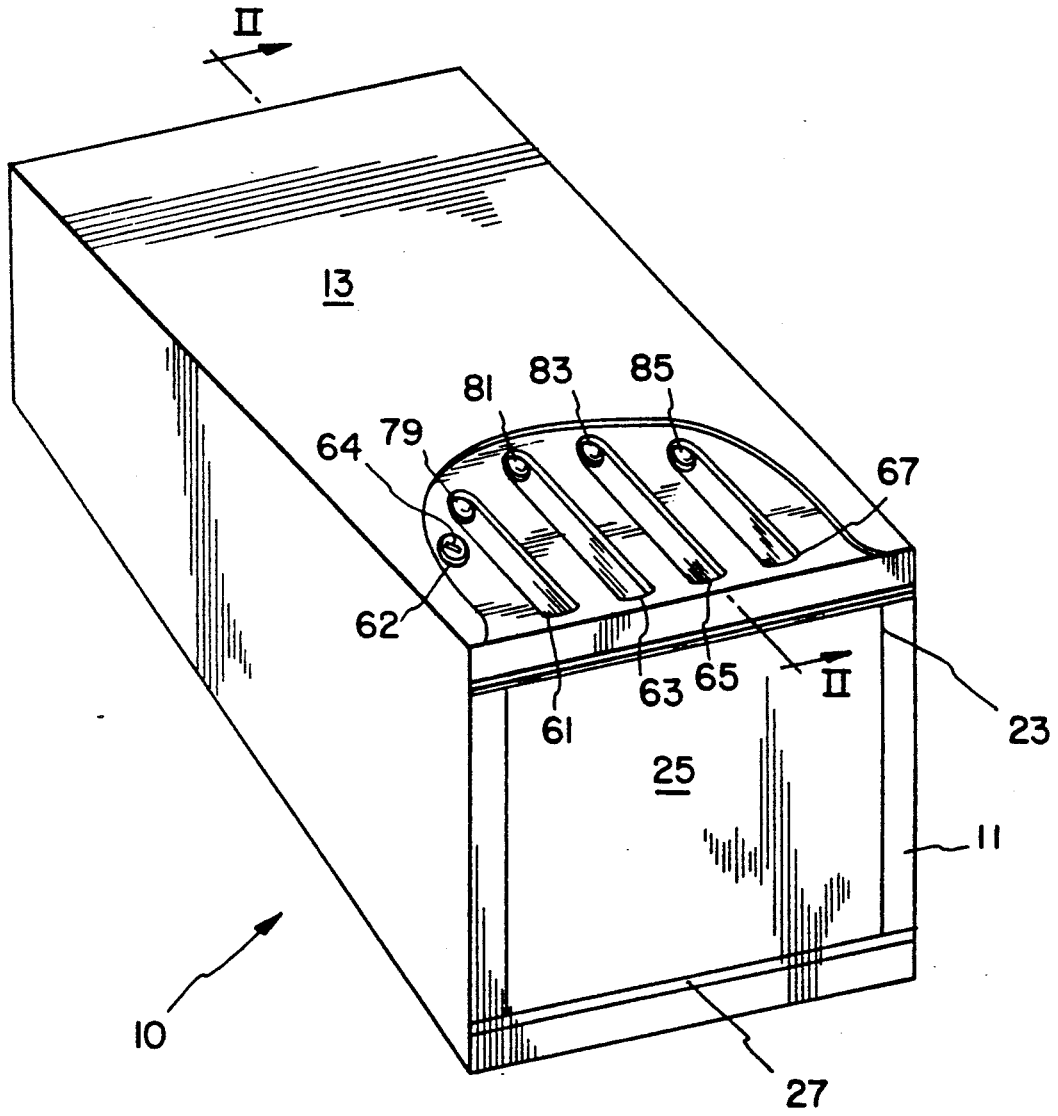
FIG. 1 shows a perspective view of the present invention.

With reference to FIGS. 1-5, the present invention is generally designated by the reference numeral 10 and includes a front wall 11, top and bottom walls 13, 15, respectively, a rear wall 17 and side walls 19 and 21.

Figure 2:
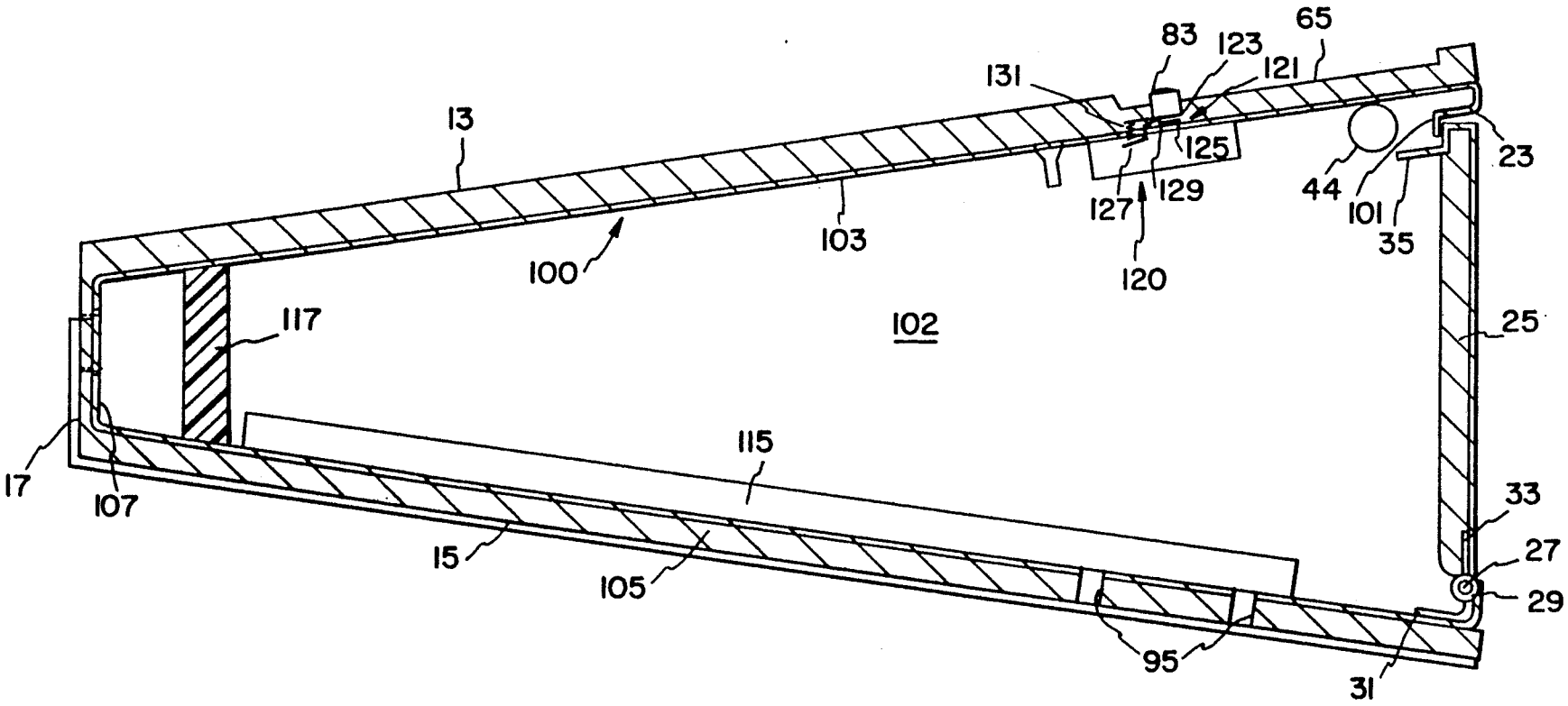
FIG. 2 shows a cross-sectional view along the line II—II of FIG. 1.

With reference to FIG. 2, it is seen that the top and bottom walls 13, 15 are angularly related with respect to one another such that they converge in a direction from the front wall 11 to the rear wall 17.

Figure 3:
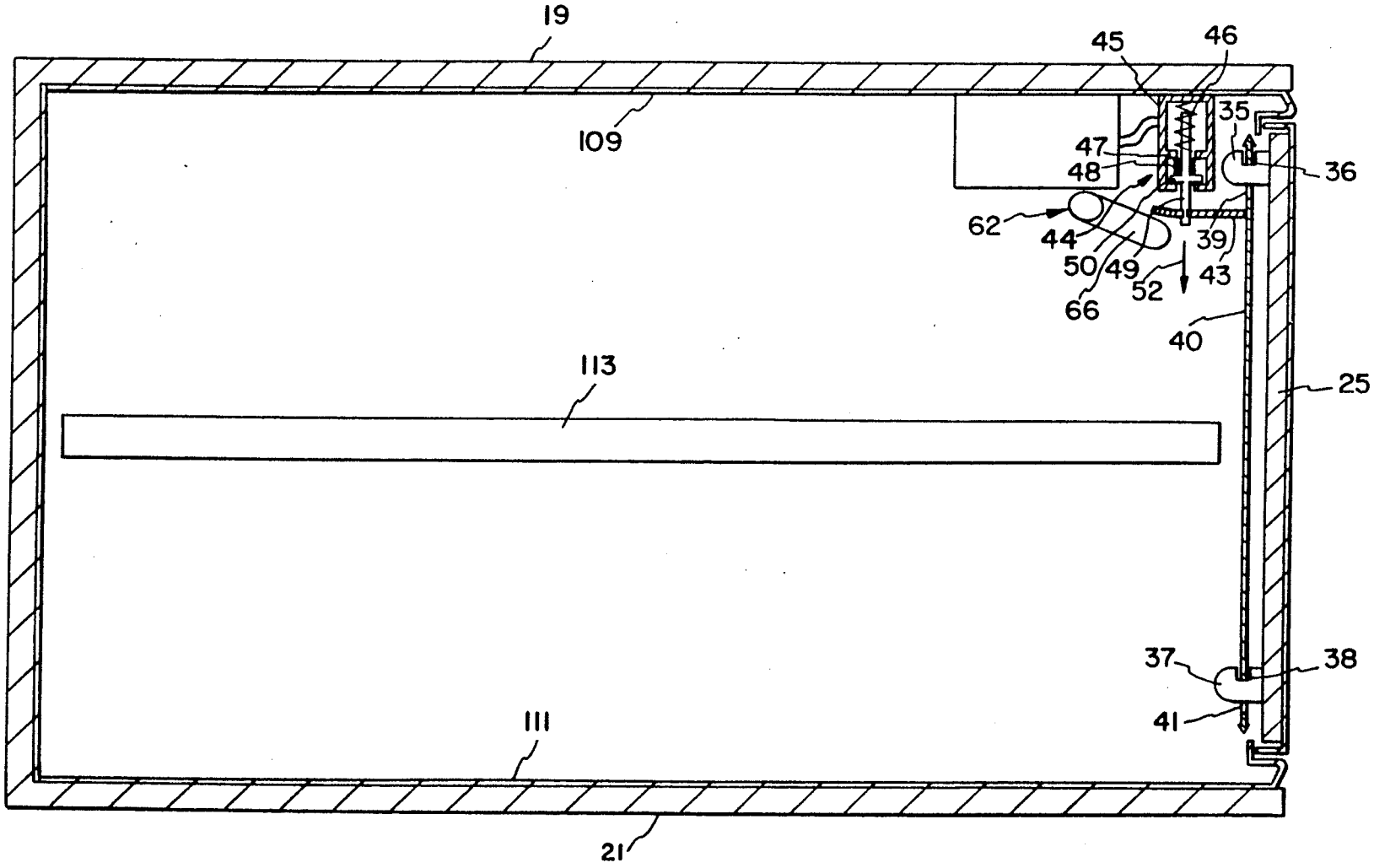
FIG. 3 shows a bottom view looking upwardly within the inner liner of the present invention.

As seen with particular reference to FIGS. 1, 2 and 3, the front wall 11 includes an opening 23 closed by a door 25 pivotably mounted at the opening 23 by a bottom located hinge 27. With particular reference to FIG. 2, it is seen that a coil spring 29 is mounted in surrounding relation to the hinge 27 and includes a first flange 31 bearing against an internal surface of the device 10 and a further flange 33 bearing against an inner surface of the door 25 thereby causing the hinge 27 to bias the door 25 in a pivotable direction of opening.

With further reference to FIGS. 2 and 3, it is seen that the door 25 includes catches 35 and 37 which, in the closed position of the door 25 (FIG. 3), extend through respective slots 39, 41 of an elongated latch bar 40. The latch bar 40 consists of an elongated flat plate having the slots 39, 41 therethrough and also includes a perpendicular actuating arm 43 (FIG. 3) which is coupled to the elongated rod 49 of a solenoid actuator 44. The solenoid actuator 44 includes a housing 45, a coil 46 surrounding the rod 49, an internal housing projection 47 and a spring 48 bearing against a shoulder protrusion 50 formed on the rod 49. In the operation of the solenoid 44, when deenergized, the spring 48 tends to move the rod 49 in the direction of the arrow 52 thereby causing the latch bar 40 to be moved to its downwardmost position as shown in FIG. 3, causing edges of the respective slots 39, 41 to enter respective recesses 36, 38 of the respective catches 35, 37 to thereby lock the door 25 in the closed position. When the solenoid 44 is activated in a manner to be described in greater detail hereinafter, such activation causes the rod 49 to move upwardly in the view of FIG. 3 against the force of the spring 48 to allow the slots 39, 41 to leave the recesses 36, 38 to thereby allow the force of the spring 27 to open the door 25.

When the solenoid 44 is de-energized, the force of the spring 48 will restore the position of the rod 49 to the position shown in FIG. 3. If, in such position, the door 25 is open, when it is desired to close the door 25, the rounded distal ends of the catches 35, 37 will engage respective edges of the slots 39, 41 to cause the elongated latch 40 to move upwardly in the view of FIG. 3 against the force of the spring 48 to allow the catches 35, 37 to enter the respective slots 39, 41 whereupon the force of the spring 48 will restore the position of the elongated latch 40 to that which is shown in FIG. 3 thereby locking the door 25 in the closed position thereof.

Figure 4:
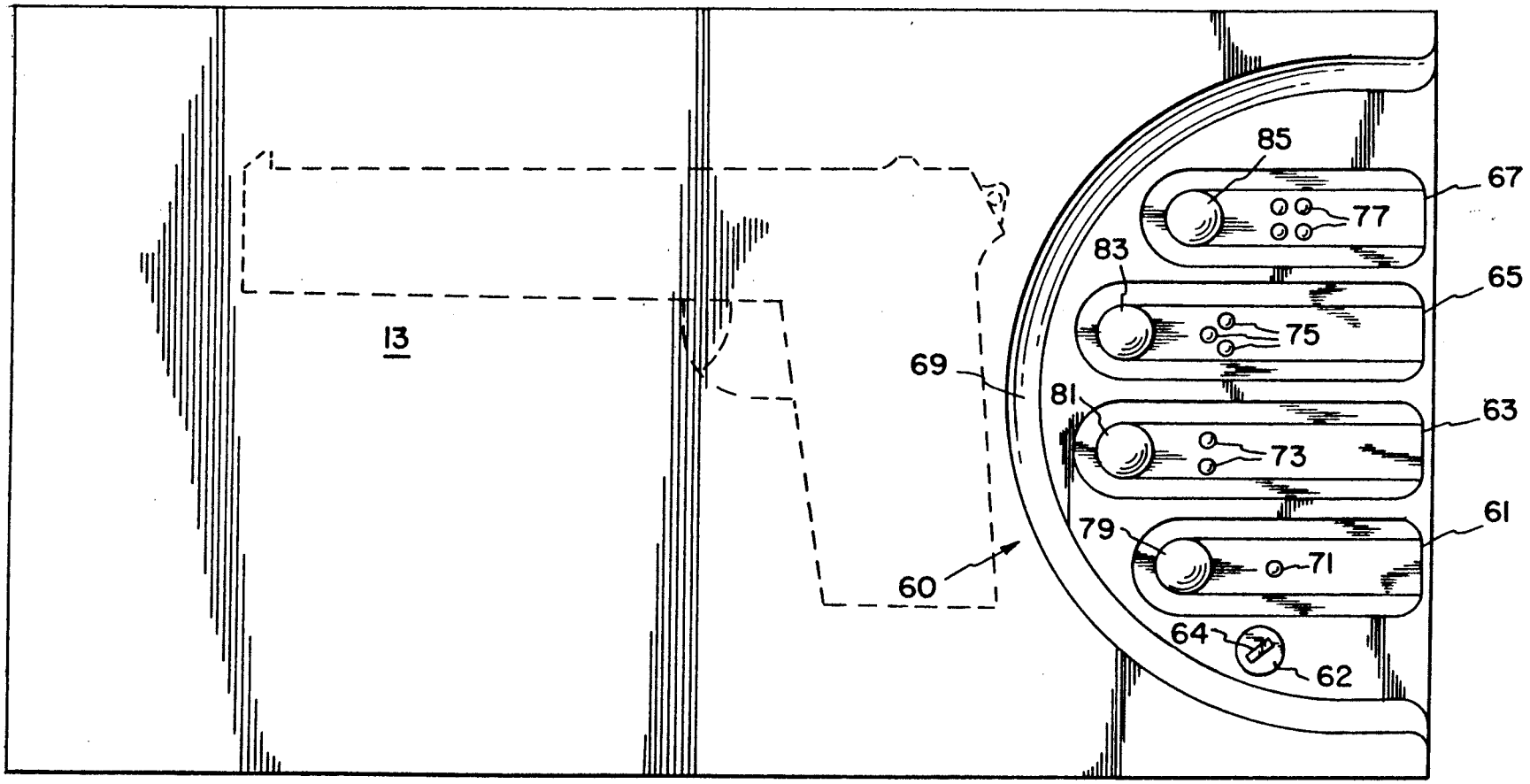
FIG. 4 shows a top view of the present invention.

With particular reference to FIG. 4, the top wall 13 of the device 10 includes a keypad generally designated by the reference numeral 60 and including generally parallel elongated recesses 61, 63, 65 and 67 all contained within a region of the box defined by a ridge-like wall 69.

As should be understood, the recesses 61, 63, 65 and 67 are sized and configured to respectively receive the four fingers, besides the thumb, of a human hand.

As shown in FIG. 4, the recess 61 includes an indicator projection 71. The recess 63 includes a pair of indicator projections 73. The recess 65 includes three indicator projections 75. Finally, the recess 67 contains four indicator projections 77. These indicator projections, in the preferred embodiment, consist of semi-spherical bumps designed to allow the user of the inventive device 10 to locate the individual recesses 61, 63, 65 and 67 even in the dark.

With further reference to FIG. 4, it is seen that each recess 61, 63, 65 and 67 has contained therein at a region remote from the front wall 11 of the device 10 an actuator button. These buttons are respectively designated by the reference numerals 79, 81, 83 and 85. Each of these buttons consists of an electronic switch actuator which when depressed closes a subcircuit of electronic circuitry forming a part of the present invention, as will be described in greater detail hereinafter. As will also be described in greater detail hereinafter, the keypad mechanism 60 consists of a keypad actuator for the locking mechanism of the inventive device 10 which allows pre-programming of a combinaton sequence of button depressions which, when properly performed, results in activation of the solenoid 44 and, thereby, opening of the door 25 to allow access to the interior of the device 10.

Also shown in FIG. 4 is the key access opening 64 of a key lock 62. With reference to FIGS. 3 and 4, the key lock 62 has a movable bar 66 which is in the position shown in FIG. 3 before actuation, engaging the bent end 68 of the actuating arm 43 of the latch 40. When the key lock is actuated responsive to insertion and rotation of the proper key into the opening 64, the bar 66 rotates counterclockwise in the view of FIG. 3 to move the arm 43 and latch 40 upwardly against the force of solenoid spring 48 to open the door 25.

Figure 5:
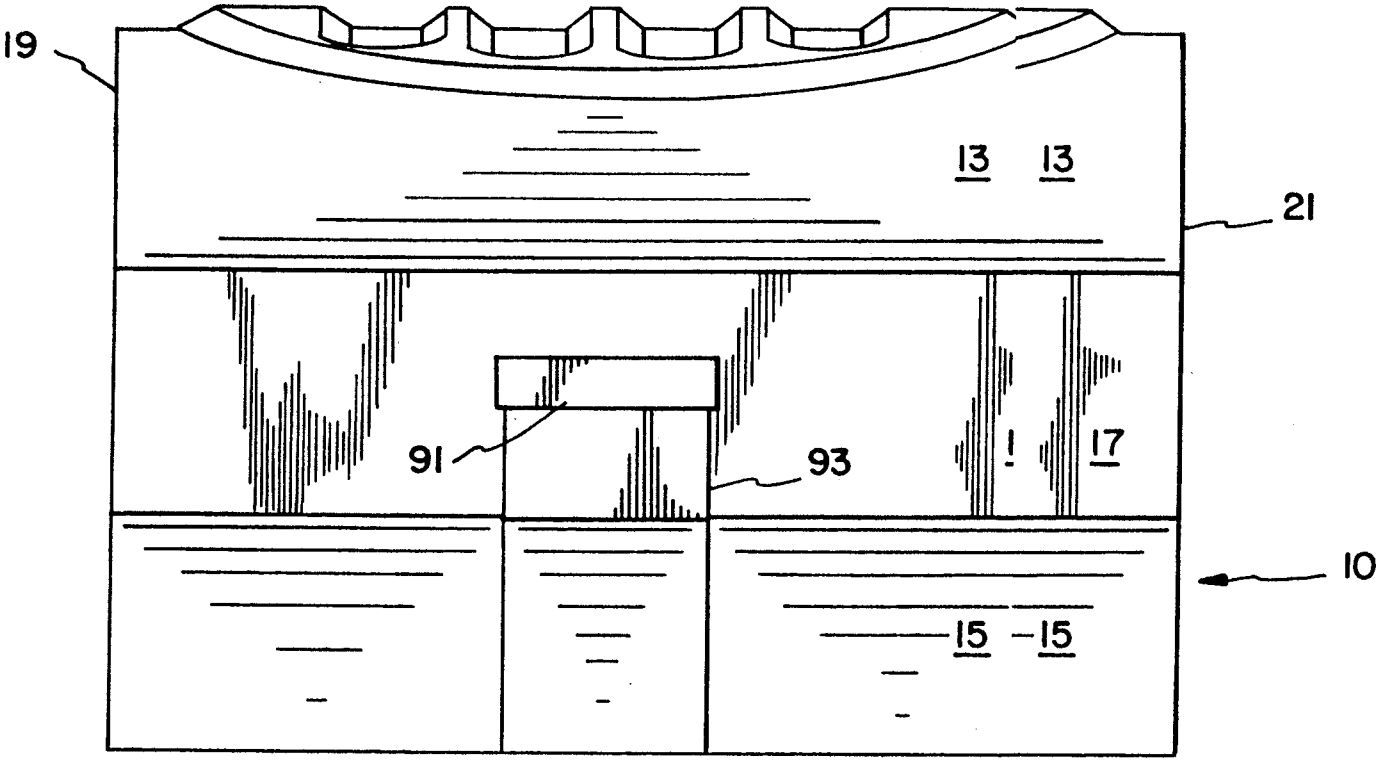
FIG. 5 shows a rear view of the present invention.

With reference to FIG. 5, the rear wall 17 of the device 10 includes an opening 91 which is closed by a removable panel 93 releasably fastened in place by any suitable means such as the screws 95 (see FIG. 2).

With further reference to FIG. 2, it is seen that the walls 11, 13, 15, 17, 19 and 21 are formed on an outer casing, preferably made of an aesthetically pleasing material such as, for example, plastic. This outer casing houses an internal subhousing 100 made of a strong, relatively impervious material such as, for example, metal. Holes 95 are provided through bottom wall 15 to allow screws (not shown) of a mounting bracket (not shown) to be installed. With reference to FIGS. 2 and 3, it is seen that the subhousing 100 has a front wall 101 which carries the hinge 27, a top wall 103, a bottom wall 105, a rear wall 107 and side walls 109, 111. FIG. 3 shows a seam 113 which is preferably welded during manufacture of the subhousing 100. Other seams (not shown) may be included in the manufacture of the subhousing 100 for strength, durability and ease of manufacture.

With reference to FIG. 2, it is seen that a foam pad 115 is mounted on an inner surface of the wall 105 and is designed to receive a firearm such as a pistol. Between the pad 115 and the rear wall 107 of the subhousing 100, a bullet-resistant wall 117, made of a material such as, for example, KEVLAR is provided so that in the event of accidental discharge of the firearm, a bullet will be prevented from exiting the device 10.

In FIGS. 2 and 3, the location of the electrical circuitry of the present invention is shown and generally designated by the reference numeral 120. FIG. 2 shows the recess 65 and the button 83 which is seen to be an actuator for the switch 121 having contacts 123 and 125 which are separated in a manner well known to those skilled in the art and which include respective electrical conductors 127, 129 connected with the electrical circuitry 120. Spring biasing means 131 is provided to cause the button 83 to be resiliently moved upwardly in the view of FIG. 2 when released by the user.

The subhousing 100 may be inserted within the outer aesthetic shell in any suitable manner and may be installed therein in any desired way such as, for example, through the use of screws, nuts, bolts or any suitable device.

Figure 6:
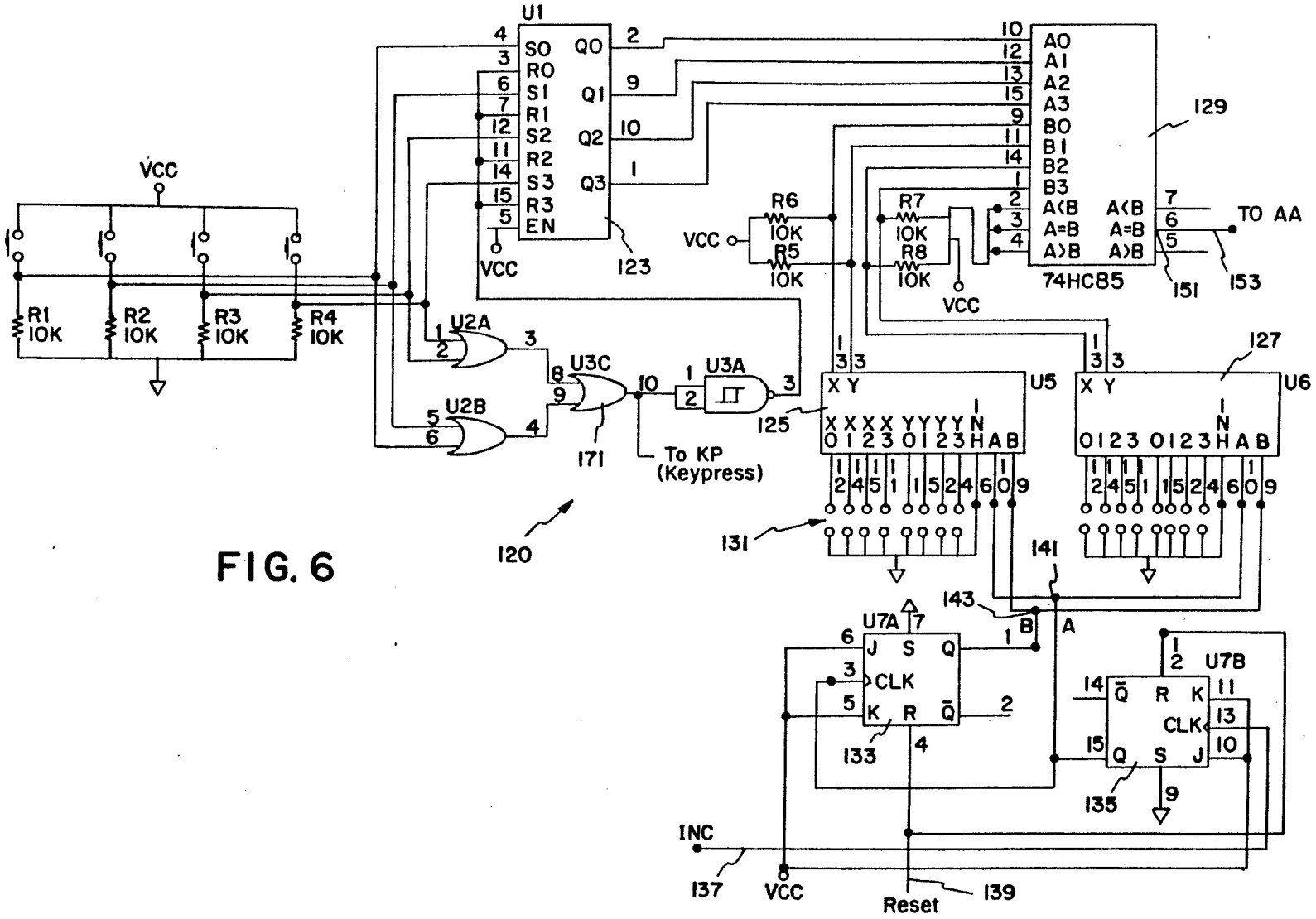
FIGS. 6 and 7 when combined together in accordance with the specification description show a schematic representation of the electrical circuitry of the present invention.
Figure 7:
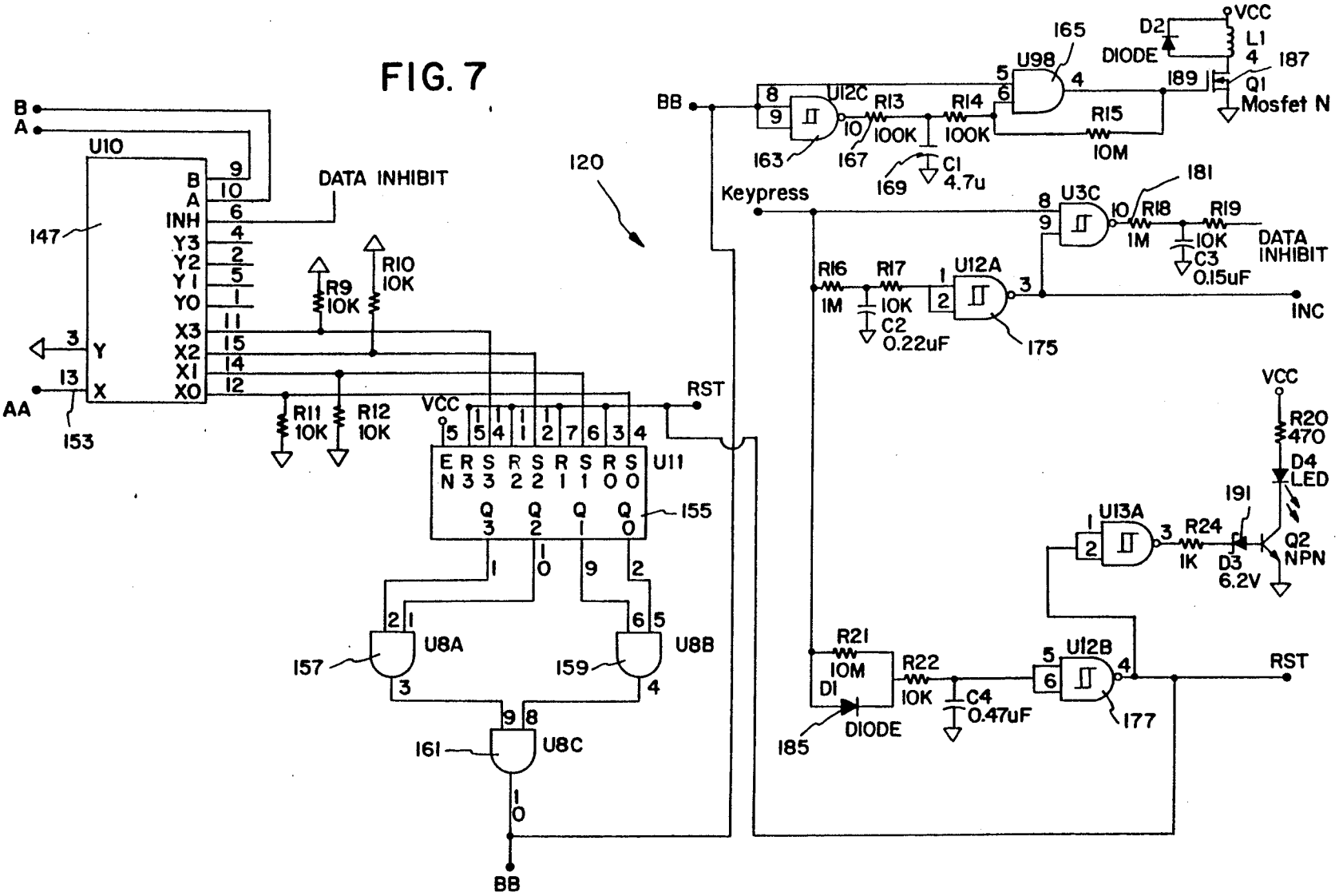

With reference, now, to FIGS. 6 and 7, a description of the preferred embodiment of electrical circuitry 120 will be made.

The electronic circuitry 120 of the present invention consists of pushbuttons, integrated circuits, resistors, capacitors, inductors, diodes, and transistors depicted in the Figures using the usual electrical symbols as commonly understood and provided (Reference numerals from the Figures are in parentheses) to perform the following functions:

- latch data generated from a sequence of actuations of pushbuttons (S1–S4) to the quad RS flip flop U1 designated by reference numeral 123;
- generate preprogrammed reference codes via analog switches U5 (125) and U6 (127) that represent the correct sequence of pushbutton actuations to operate the mechanical latch 40 of the door 25;
- perform a bitwise comparison of the data generated via the pushbutton actuations against preprogrammed reference codes in the comparator U4 (129);
- energize solenoid L1 (44) after the successful entry of the correct sequence of pushbutton actuations. Solenoid 44 is energized for a period of, for example, 500 ms. This allows the spring loaded door 25 to open;
- demonstrate that sufficient battery power exists to operate the inventive electronics.

Pushbuttons S1, S2, S3 and S4 correspond to respective pushbuttons 79, 81, 83 and 85 and are provided for the user to input data for verification of the correct access code to open the door 25, or for rejection with access denied when the proper sequence is not used. Resistors R1–R4 are pulldown resistors that provide a logical low when the pushbuttons are not activated.

The pushbutton data are inputted to the set pin of the flip flops of chip U1 (123), and are latched to the flip flop outputs. The enable pin of U1 is always high so that the flip flops are always able to accept input data. The reset pins are connected to the inverted Keypress signal, KP'. When any of the pushbuttons is depressed, the KP' signal goes low allowing data at the inputs of U1 to be latched to the Q outputs thereof, Q0, Q1, Q2 and Q3. The Q outputs of U1 are connected to inputs A0–A3 of chip U4 (129) which is a 4 bit magnitude comparator. When the pushbutton data are latched to the input of the magnitude comparator 129, they are ready for verification against the preprogrammed reference codes.

Chips U5 (125) and U6 (127) are dual 4 channel analog multiplexers. Channels X0–X3 and Y0–Y3 of the chips 125, 127 are used to program the access code of the circuit. Each entry consists of 1, 2, 3, or 4 simultaneous actuations of pushbuttons S1–S4. The access code is four entries long. Channels X0 and Y0 of the chip U5, X0 and Y0 of the chip U6, represent switches S1–S4 for the first entry. Similarly, channels X1 and Y1 of chip U5, and channels X1 and Y1 of chip U6 represent switches S1–S4 for the second entry. This method is used to represent the required actuations for all four entries. A two bit counter signal applied to inputs A and B of chips U5 and U6 is used to select the correct codes from the sixteen available channels. A channel is programmed to require the actuation of a button by leaving open the connection between chip U5, or U6 and ground. Pullup resistors R6–R8 then represent the channel as a high. A button is left out of the access code by grounding the channel input with a jumper, or hard wired connection as provided for in the Figures. For example, jumper 131 connects channel X0 of the chip U5 (125) to ground. The examples in Table 1 show the programming requirements for 4 different combinations. A "G" represents a grounded pin on chip U5, or U6. An "O" represents an open pin on chip U5, or U6. The commas separate each sequential button actuation.

TABLE 1

| | | | | | | | | | | | | | | | |
|---|---|---|---|---|---|---|---|---|---|---|---|---|---|---|---|
| Combination: (S1), (S2), (S3), (S4) | | | | | | | | | | | | | | | |
| U5 (125) | | | | | | | | U6 (127) | | | | | | | |
| X0 | X1 | X2 | X3 | Y0 | Y1 | Y2 | Y3 | X0 | X1 | X2 | X3 | Y0 | Y1 | Y2 | Y3 |
| O | G | G | G | G | O | G | G | G | G | O | G | G | G | G | O |
| Combination: (S1 S2), (S2 S3), (S3 S4), (S4 S1) | | | | | | | | | | | | | | | |
| U5 (125) | | | | | | | | U6 (127) | | | | | | | |
| XO | X1 | X2 | X3 | Y0 | Y1 | Y2 | Y3 | X0 | X1 | X2 | X3 | Y0 | Y1 | Y2 | Y3 |
| O | G | G | O | O | O | G | G | G | O | O | G | G | G | O | O |
| Combination: (S1 S2 S3), (S2 S3 S4), (S3 S4 S1), (S4 S1 S2) | | | | | | | | | | | | | | | |
| U5 (125) | | | | | | | | U6 (127) | | | | | | | |
| XO | X1 | X2 | X3 | Y0 | Y1 | Y2 | Y3 | X0 | X1 | X2 | X3 | Y0 | Y1 | Y2 | Y3 |
| O | G | O | O | O | O | G | O | O | O | O | G | G | O | O | O |
| Combination: (S1), (S1 S2), (S1 S2 S3), (S1 S2 S3 S4) | | | | | | | | | | | | | | | |
| U5 (125) | | | | | | | | U6 (127) | | | | | | | |
| XO | X1 | X2 | X3 | Y0 | Y1 | Y2 | Y3 | X0 | X1 | X2 | X3 | Y0 | Y1 | Y2 | Y3 |
| O | O | O | O | G | 0 | 0 | 0 | G | G | O | O | G | G | G | O |

The two bit binary ripple counter (133, 135) is constructed from chip (U7A and U7B) U7, a dual CD4027 JK flip flop. The clock is triggered by the rising edge of the INC signal on conductor 137. The Counter Enable line of the chip U7 is tied high so that the counter is always ready for use. A reset signal, RST, is connected to the reset line of the counter by conductor 139. The RST signal goes low after each pushbutton actuation and stays low for 5 seconds. If after 5 seconds, another keypress signal is not generated, the RST signal goes high resetting the counter to its 00 state. The counter output is provided on lines A and B at reference numerals 141, 143. The least significant counter bit is on line A at 141, the most significant bit is on line B at 143. The counter output is used to control all three multiplexers in the circuit, chips U5 (125), U6 (127), and U10 (147).

The 74HC85 4-bit magnitude comparator (129) U4, performs a bitwise comparison of the data generated by the pushbutton actuations against the preprogrammed reference data on parts U5 (125) and U6 (127). These data are input to pins A0–A3 and B0–B3 of U4. If the data on pins A0–A3 of U4 are identical to the data on pins B0–B3 of U4, then the A=B pin 151 goes high.

Otherwise, the A=B pin is low. The output of the 4-bit magnitude comparator is connected to the X input of multiplexer (147) U10 via conductor 153. The multiplexer directs the results of each comparison to one of the inputs of chip U11 (155), a quad RS flip flop that functions as a latch. The outputs of the latch are ANDed together by chips U8A (157), U8B (159), and U8C (161). If the sequence of pushbutton actuations positively correlate to the preprogrammed access codes, then the output of chip U8C (161) goes high. The output of chip U8C is connected to a pulse generator consisting of gates U12C (163), U9B (165), R13 (167), and C1 (169). If the output of chip U8C (161) goes high, these components generate a pulse that energizes the solenoid, for example, for 0.5 seconds.

There are four timing signals that control the propagation of data through the circuit: KP (keypress), INC (increment), RST (reset), and Data Inhibit. The KP signal occurs every time a pushbutton is actuated. The KP signal, generated at the output of chip U3C (171), is the result of "ORing" the pushbutton outputs together. The other three timing signals are derived from the KP signal. The INC signal, emanating from chip U12A (175), increments the ripple counter by a rising edge transition after each entry occurs. The RST signal, emanating from chip U12B (177), resets the counter 5 seconds after a pushbutton actuation is made. This gives the user a 5 second maximum interval between any two entries. The Data Inhibit signal, emanating from resistor R19 (181), is used to gate the output of the magnitude comparator through the multiplexer, U10 (147), to the latch U11 (155). The shape and duration of these timing signals is determined by the values of various resistors and capacitors.

The solenoid circuitry consists of Q1 (187) and D1 (185). The high current N-channel MOSFET (187) is used to switch the solenoid on and off. Diode D1 (185) is used to shunt any high voltage transients that might result from turning the solenoid current off.

The battery test function is achieved with diode D2 (189), a light emitting diode. The diode will light up only if transistor Q2 (189) is switched on. A minimum voltage of 6.9 vdc must be applied to the cathode of zener diode D3 (191) to turn transistor Q2 on. If the battery voltage drops below 6.9 vdc, then U13A will generate a high output voltage less than 6.9 volts, and the LED will not light.

The electrical circuit 120 is designed to operate using six 1.5 volt AA Alkaline batteries. These batteries usually have a capacity of 2 Amp hours. The typical quiescent current of the CMOS components is 1 micro amp. The Solenoid draws 3 amps maximum for 0.5 seconds each time the Gunvault is opened via the electrical circuit 120. The low power characteristics of the electronics will guarantee reliable battery powered operation for a minimum of 6 months even with the box being opened twice per day.

There are 50,625 possible valid programmable combinations for the electrical circuit 120. This is determined by the fact that there are 4 combinations to push 1 of 4 buttons at a time, 6 combinations to push 2 of 4 buttons at a time, 4 combinations to push 3 of 4 buttons at a time, and 1 combination to push 4 of 4 buttons at a time. These possibilities total 15 for each entry. There are 4 entries. Consequently, there are $15^4$, or 50625 possible combinations.

If desired, the inventive circuitry 120 might easily have included therewith an alarm which would be activated responsive to a predetermined number of attempted sequences of depressions of the switches S1–S4. Thus, for example, if, after three tries, the correct sequence is not achieved, the circuit 120 might be disabled for one or two minutes.

As should be understood by those skilled in the art and with particular reference to FIGS. 1 and 4, the keypad 60 is ergonometrically designed to be manipulated even in the dark. Thus, the user might use their fingertips to locate the protrusions 71, 73, 75 and 77 to orient themselves as to which buttons 79, 81, 83 and 85 are being engaged. Thereafter, the correct sequence of depressions of these buttons may be correspondingly inputted.

As such, an invention has been disclosed in terms of a preferred embodiment thereof which fulfills each and every one of the objects of the invention as set forth hereinabove and provides a new and useful tamper proof lockable firearm case. Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved firearm case, comprising:

a) a housing having an inner chamber sized to contain a firearm and an opening at an end of said housing closed by an access door biased toward an open position thereof and held in a closed position thereof by a releasable latch;

b) said housing containing an electrical circuit controlling release of said latch;

c) a plurality of switches in said electrical circuit, each switch being actuable from outside said housing via a corresponding plurality of actuating buttons mounted to protrude through an outer surface of said housing;

d) said circuit being preprogrammed to release said latch responsive to actuation of said buttons in a particular sequence; and e) said housing having a depressed area surrounding each button to allow locating said buttons by feel and without viewing said buttons, each said area extending from adjacent an edge of said housing adjacent said opening to a location of termination remote therefrom linearly along an axis extending therebetween each depressed area being elongated and being upwardly open throughout the length of said axis, each respective button being located within its respective depressed area adjacent the location of termination thereof and spaced from said edge, whereby a user may feel said edge, may locate said elongated depressed areas with the user's fingers and may slide the user's fingers along the respective axes of the elongated depressed areas until said buttons are located.

2. The invention of claim 1, wherein said access door is biased toward said open position thereof by a resilient spring.

3. The invention of claim 1, further wherein said latch is operatively connected to a solenoid actuator, said solenoid actuator being electrically connected to said circuit, said circuit sending an electrical actuating pulse to said solenoid actuator responsive to actuation of said buttons in said particular sequence.

4. The invention of claim 1, further including a key operated door actuator.

5. The invention of claim 1, further including a battery contained within said chamber and actuating said circuit.

6. The invention of claim 1, wherein said circuit includes a comparator for comparing actual actuations of said buttons with a preprogrammed said particular sequence.

7. The invention of claim 6, wherein said particular sequence is preprogrammed in a dual plural channel analog multiplexer.

8. The invention of claim 1, wherein said chamber is at least partially surrounded with bullet resistant material.

9. The invention of claim 1, wherein each depressed area contains a unique set of small protrusions to allow easy identification of each button.

10. The invention of claim 1, wherein adjacent depressed areas are separated by respective relatively raised areas combined together to form a raised generally semi-circular region.

* * * * *